US011767855B2

(12) United States Patent
Yang

(10) Patent No.: US 11,767,855 B2
(45) Date of Patent: Sep. 26, 2023

(54) DUAL-SHAFT BUILT-IN PUMP

(71) Applicant: DONGGUAN HONGSHENG METAL&PLASTIC TECHNOLOGY CO., LTD., Guangdong (CN)

(72) Inventor: Chunhua Yang, Guangdong (CN)

(73) Assignee: DONGGUAN HONGSHENG METAL & PLASTIC TECHNOLOGY CO., LTD., Dongguan (CN)

( * ) Notice: Subject to any disclaimer, the term of this patent is extended or adjusted under 35 U.S.C. 154(b) by 0 days.

(21) Appl. No.: 17/654,163

(22) Filed: Mar. 9, 2022

(65) Prior Publication Data

US 2023/0175518 A1 Jun. 8, 2023

(30) Foreign Application Priority Data

Dec. 3, 2021 (CN) ..... 202123024980.3

(51) Int. Cl.

| | |
|---|---|
| ***F04D 29/043*** | (2006.01) |
| ***F04D 19/00*** | (2006.01) |
| ***F04D 29/70*** | (2006.01) |
| ***F04D 25/08*** | (2006.01) |
| ***F04D 29/50*** | (2006.01) |

(52) U.S. Cl.

CPC ..... *F04D 29/043* (2013.01); *F04D 19/002* (2013.01); *F04D 25/084* (2013.01); *F04D 29/503* (2013.01); *F04D 29/703* (2013.01)

(58) Field of Classification Search

CPC .... F04D 29/043; F04D 19/002; F04D 25/084; F04D 29/503; F04D 29/703

See application file for complete search history.

(56) References Cited

U.S. PATENT DOCUMENTS

2020/0046135 A1* 2/2020 Lau ..... F04D 25/0606
2020/0063745 A1* 2/2020 Yang ..... F04D 25/166

FOREIGN PATENT DOCUMENTS

CN 108678932 A 10/2018
CN 214499529 U 10/2021

* cited by examiner

*Primary Examiner* — Grant Moubry
*Assistant Examiner* — Ruben Picon-Feliciano
(74) *Attorney, Agent, or Firm* — SHIMOKAJI IP

(57) ABSTRACT

A dual-shaft built-in pump includes a main body, provided with an air inlet and an air outlet; a motor cover, provided with an accommodating cavity having an air inflation vent and an air deflation vent; two valve bodies; a first fan blade, located between the air inflation vent and the air inlet; a second fan blade, located between the air deflation vent and the air outlet; a dual-shaft motor, configured in the accommodating cavity and having an output shaft connected with the first fan blade and the second fan blade; and a rotating member, rotatably provided on the main body and configured to drive either of the two valve bodies thereby opening the air inlet or the air outlet. The pump has simple structure, convenient fabrication and low cost.

18 Claims, 9 Drawing Sheets

DUAL-SHAFT BUILT-IN PUMP

FIELD OF THE INVENTION

The present invention relates to a built-in pump, and more particularly to a dual-shaft built-in pump.

BACKGROUND OF THE INVENTION

A built-in pump is an electric pump that is built into an air bag of an inflatable product to inflate and deflate the air bag. Existing built-in pumps usually use only one motor to inflate and deflate. As known, when the fan blades are rotated under the driving of the motor, the airflow is outputted in only one direction, in view of this, a movable valve is usually configured within the built-in pump to switch the air inlet duct and the air outlet duct, so that the direction of the airflow can be changed to achieve the switch between inflation and deflation. However, it is necessary to skillfully configure the air inlet duct and the air outlet duct inside the pump, which leads to complicated structures of these ducts, and brings difficult processing and high costs.

SUMMARY OF THE INVENTION

One objective of the present invention is to provide a dual-shaft built-in pump, which has simple structure, convenient fabrication and low cost.

To achieve the mentioned above objective, the present invention provides a dual-shaft built-in pump including: a main body, provided with an inner cavity and an inlet communicated with the inner cavity, and the inner cavity having an air inlet and an air outlet; a motor cover, provided with an accommodating cavity having an air inflation vent that is communicated with the air inlet and an air deflation vent that is communicated with the air outlet; two valve bodies, one of the valve bodies being configured at the air inlet, and another of the valve bodies being configured at the air outlet; a first fan blade, located between the air inflation vent and the air inlet; a second fan blade, located between the air deflation vent and the air outlet; a dual-shaft motor, configured in the accommodating cavity and having an output shaft which has an end connected with the first fan blade and another end connected with the second fan blade; and a rotating member, rotatably provided on the main body and configured to drive either of the two valve bodies thereby opening the air inlet or the air outlet.

In comparison with the prior art, the air inlet and the air outlet are arranged in the inner cavity of the main body according to the present invention, so that the air inlet is communicated with the air inflation vent of the accommodating cavity, and the air outlet is communicated with the air deflation vent of the accommodating cavity, the first fan blade s arranged between the air inflation vent and the air inlet, the second fan blade is arranged between the air deflation vent and the air outlet duct, and two valve bodies are arranged on the air inlet and the air outlet, respectively. Therefore, either of the two valve bodies can be driven by means of the rotating member, thereby opening the air inlet and the air outlet. After the air inlet is opened, the air can flow in through the air inflation vent; after the air outlet is opened, the air can flow out from the air deflation vent. In such a way, there is no need to switch the air ducts inside the pump, the structure of the air duct is simplified, and the processing is convenient. In addition, the main body and the motor cover are configured, the rotating member and the two valve bodies are arranged on the main body, and the dual-shaft motor, the first fan blade and the second fan blade are arranged on the motor cover, therefore, it's only required to assemble the main body with the motor cover during the assembly, which brings a simple assembly and reduced processing costs.

As an embodiment, a rotation center axis of the output shaft of the dual-shaft motor is parallel to that of the rotating member.

As an embodiment, the air inlet and the air outlet are located between the first fan blade and the second fan blade.

As an embodiment, the motor cover is provided with an air outlet duct, one end of the air outlet duct is communicated with the air outlet of the inner cavity, and another end of the air outlet duct is communicated with the air deflation vent of the accommodating cavity.

As an embodiment, the output shaft of the dual-shaft motor is perpendicular to a rotation center axis of the rotating member.

As an embodiment, the accommodating cavity is provided with a first cavity, a second cavity and a third cavity, and the first fan blade is located in the first cavity, the air inflation vent is communicated with the first cavity; the second fan blade is located in the third cavity, and the air deflation vent is communicated with the third cavity; and the dual-shaft motor is configured in the third cavity.

As an embodiment, one side of the motor cover is provided with an air inlet duct, and another side of the motor cover is provided with an air outlet duct; one end of the air inlet duct is communicated with the air inlet, and another end of the air inlet is communicated with the air inflation vent of the accommodating cavity; one end of the air outlet duct is communicated with the air inflation vent, and another end of the air outlet duct is communicated with the air deflation vent of the accommodating cavity.

As an embodiment, each valve body comprises a support, an elastic restoring member and a sealing member, the support is movably configured in the main body, one end of the elastic restoring member is pressed against an inner wall of the support, and another end of the elastic restoring member is pressed against the support, the sealing member is disposed on the support and configured to seal the inner cavity under an elastic force of the elastic restoring member.

As an embodiment, the motor cover is provided with two movable chambers isolated from one another, one of the movable chambers is located between the air inlet and the accommodating cavity and communicated with the accommodating cavity to receive the valve body disposed at the air inlet, another of the movable chambers is located between the air outlet and the accommodating cavity and communicated with the accommodating cavity to receive the valve body disposed at the air outlet.

As an embodiment, a guide rail is arranged on the rotating member and provided with a protruding portion that is configured to push one of the valve bodies thereby opening the air inlet or the air outlet.

As an embodiment, the pump further includes an elastic member configured between the main body and the rotating member, so that the rotating member is attached to the main body.

As an embodiment, the rotating member is provided with an engaging portion, the main body is provided with a plurality of recesses, and the engaging portion is configured to engage with one of the recesses after the rotating member is rotated by a certain angle.

As an embodiment, a surface of the main body is provided with a through hole communicating with the inner cavity, and the rotating member is configured at the through hole.

As an embodiment, the main body is provided with a storage chamber for storing wires connected to the dual-shaft motor, and a cover is provided at an opening of the storage chamber.

As an embodiment, the main body comprises a main portion and a top cover disposed on a surface of the main body, and an outer surface of the main body is provided with a rubber layer.

As an embodiment, the air inflation vent and the air deflation vent are provided with a protective cover, respectively, which is hollow.

As an embodiment, the protective cover is made of a flexible material.

BRIEF DESCRIPTION OF THE DRAWINGS

The accompanying drawings facilitate an understanding of the various embodiments of this invention. In such drawings.

DETAILED DESCRIPTION OF ILLUSTRATED EMBODIMENTS

Figure 1:
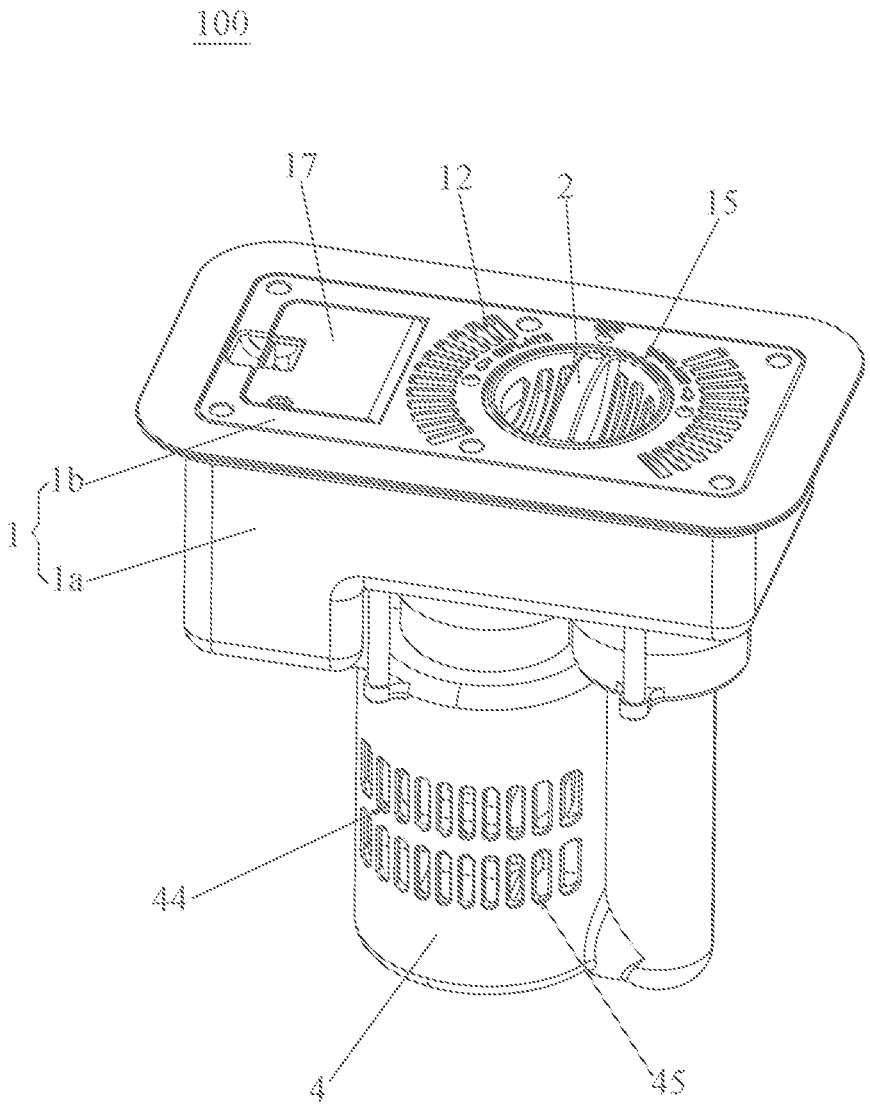
FIG. 1 is a perspective view of a dual-shaft built-in pump according to a first embodiment of the present invention.

The present invention will be described in detail below with reference to the accompanying drawings and preferred embodiments.

As illustrated in FIGS. 1-6, a dual-shaft built-in pump 100 of a first embodiment of the present invention is shown. The dual-shaft built-in pump 100 in the present embodiment includes a body 1, a rotating member 2, two valve bodies 3, a motor cover 4, a dual-shaft motor, a first fan blade 6 and a second fan blade 7. Specifically, the body 1 is provided with an inner cavity 11 and an inlet 12 communicated with the inner cavity 11, and the inner cavity 11 has an air inlet 13 and an air outlet 14. The motor cover 4 is provided with an accommodating cavity 41 and an air outlet duct 42 which are arranged at left and right respectively. The accommodating cavity 41 has an air inflation vent 44 that is communicated with the air inlet 13 of the inner cavity 11 and an air deflation vent 45 that is communicated with the air outlet 14 of the inner cavity 11. One of the valve bodies 3 is configured at the air inlet 13, and the other of the valve bodies 3 is configured at the air outlet 14. More specifically, the air inlet 13 and the air outlet 14 are arranged at left and right respectively and the both are located below the rotating member 2. One end of the air outlet duct 42 is communicated with the air outlet 14, the other end of the air outlet duct 42 is communicated with the air deflation vent 45 of the accommodating cavity 41. The dual-shaft motor 5 is configured in the accommodating cavity 41 and has an output shaft which has an end connected with the first fan blade 6 and another end connected with the second fan blade 7. The firs fan blade 6 is located between the air inflation vent 44 and the air inlet 13, and the second fan blade is located between the air inflation vent 44 and the air outlet duct 42. That is, the air inflation vent 44 and the air deflation vent 45 are located between the first fan blade 6 and the second fan blade 7, which can be shared as the same vent. Both of the first fan blade 6 and the second fan blade 7 in this embodiment are axial flow fan blades and installed in the same direction. The surface of the main body 1 is provided with a through hole 15 which is communicated with the inner cavity 11, and the rotating member 2 is rotatably arranged on the through hole 15 and configured to drive any one of the two valve bodies 3 so as to open the air inlet 13 or the air outlet 14.

Figure 2:
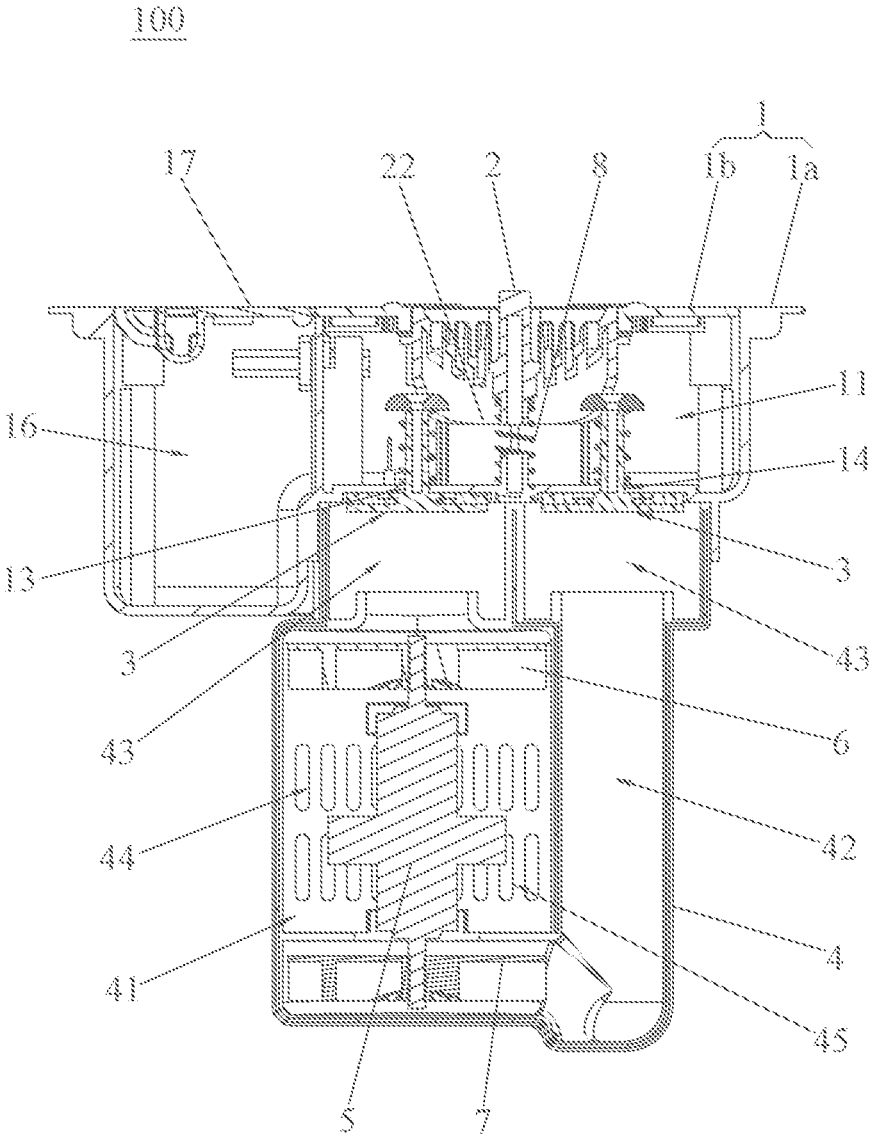
FIG. 2 is a cross-section view of a dual-shaft built-in pump according to the first embodiment of the present invention.

Referring to FIG. 2, a rotation center axis of the output shaft of the dual-shaft motor 5 is parallel to a rotation center axis of the valve body 3, and the dual-shaft motor 5 is located below the air inlet 13. In such a way, the dual-shaft motor 5 is arranged vertical relative to the body 1, so that the space in the depth direction of the air bag can be better utilized when it is installed inside the air bag, so that the lateral size of the dual-shaft built-in pump 100 is smaller, therefore, the area exposed on the surface of the air bag is less, and the appearance of the air bag is improved.

Figure 3:
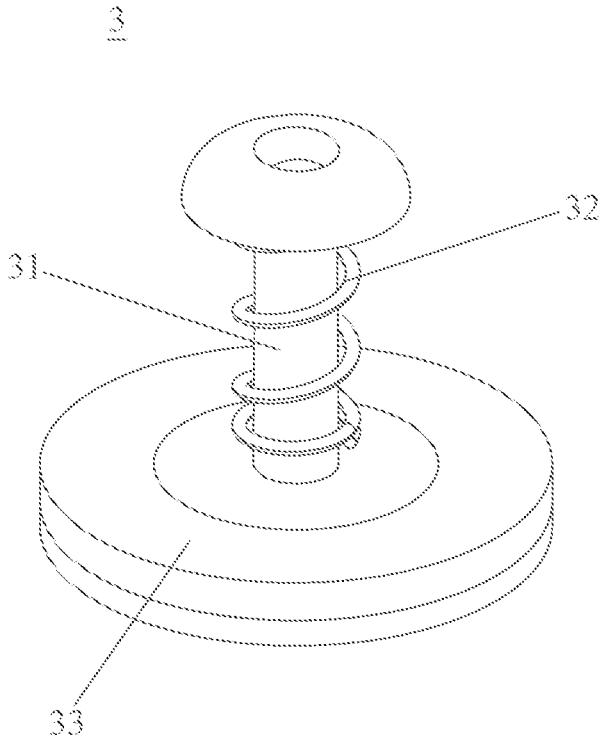
FIG. 3 is a schematic view of a valve body of the dual-shaft built-in pump according to the first embodiment of the present invention.

Referring to FIGS. 2 and 3, the valve body 3 includes a support 31, an elastic restoring member 32 and a sealing member 33. Specifically, the support 31 has an inverted T-shaped structure and is movably configured in the body 1. One end of the elastic restoring member 32 is pressed against an inner wall of the support 31, and another end of the elastic restoring member 32 is pressed against the support 31, specifically, the elastic restoring member 32 is a compression spring sleeved on the cylinder of the support 31. The sealing member 33 is disposed on the support 31 and configured to seal the inner cavity 11 under an elastic force of the elastic restoring member 32. Specifically, the sealing member 33 of the valve body 3 corresponding to the air inlet 13 is configured to seal the air inlet 13, while the sealing member 33 of the valve body 3 corresponding to the air outlet 14 is configured to seal the air outlet 14. The motor cover is provided with two movable chambers 43 isolated from one another, one of the movable chambers 43 is located between the air inlet 13 and the accommodating cavity 41 and communicated with the accommodating cavity 41 to receive the valve body 3 disposed at the air inlet 13, another of the movable chambers 43 is located between the air outlet 14 and the air outlet duct 42 and communicated with the air outlet duct 42 to receive the valve body 13 disposed at the air outlet 14. By arranging the movable chambers 43, the valve bodies 13 cam be operated stably, which avoids an incomplete opening of the air inlet 13 or the air outlet 14 due to interferences, thereby ensuring quick and stable inflation and deflation.

Figure 4:
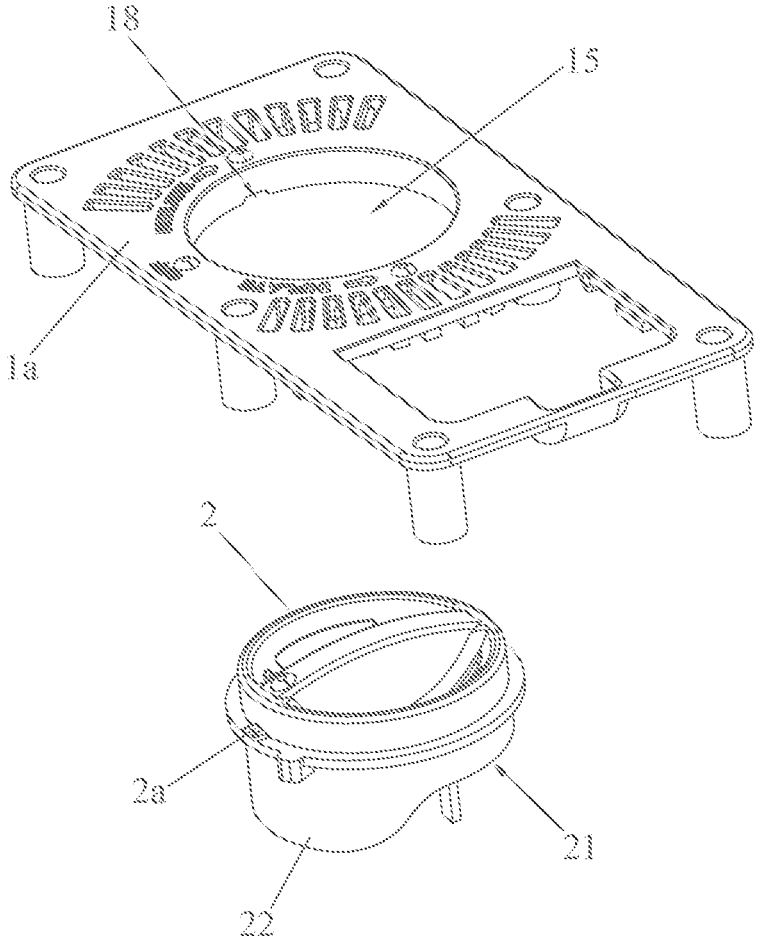
FIG. 4 is an exploded view of a main body and a rotating member of the dual-shaft built-in pump according to the first embodiment of the present invention.

As shown in FIG. 2 and FIG. 4, the rotating member 2 has a cylindrical structure, and a guide rail 21 is arranged on the lower edge of the rotating member 2 in the circumferential direction, and the guide rail 21 is provided with protruding portion 22 adapted for pushing the valve body 3, so to open the air inlet 13 or the air outlet 14. The protruding portion 22 is gradually protruded along the guide rail 21, so that the contact between the guide rail 21 and the valve body 3 can be smooth. When the rotating member 2 rotates, the valve body 3 is kept in a closed state due to the guide rail 21; while one of the valve bodies 3 can be selectively opened by means of the protruding portion 22. In addition, a mark corresponding to the protruding portion 22 can be provided on the surface of the rotating member 2, and an inflation mark, a deflation mark and a closing mark can be provided on the surface of the main body 1, and the inflation mark corresponds to the air inlet 13, and the deflation mark corresponds to the air outlet 14, so as to facilitate the operation during inflation and deflation.

Please refer to FIG. 2 and FIG. 4 again, the dual-shaft built-in pump 100 further includes an elastic member 8 which is a compression spring preferably. The elastic member 8 is disposed between the main body 1 and the rotating member 2 and sleeved on the central axis of the rotating member 2, such that the rotating member 2 is pressed against the main body under the elastic force of the elastic member 8. The rotating member 2 is provided with an engaging portion 2*a*, the main body 1 is provided with a plurality of recesses 18, and the engaging portion 2*a* is configured to engage with one of the recesses 18 after the rotating member 2 is rotated by a certain angle. By using the engaging portion 2*a* to cooperate with the recesses 18 and combining with the elastic member 8, the rotating member 2 can be positioned at a specific angle, without unexpected rotation, thereby ensuring a quick and stable air inflation or air deflation, and effectively improving the stability during work.

As shown in FIGS. 1 and 2, the body 1 is provided with a storage chamber 16 for accommodating wires connected to the dual-shaft motor 5, and a cover 17 is provided at the opening of the storage chamber 16. In this way, the wires can be stored when not inflated and deflated, which is more convenient.

As shown in FIG. 1 again, the main body 1 includes a main portion 1*a* and a top cover 1*b* disposed on the surface of the main portion 1*a*. The outer side of the main portion 1*a* is provided with a rubber layer which can be easily connected with the air bag to improve the convenience of assembly.

Figure 5:
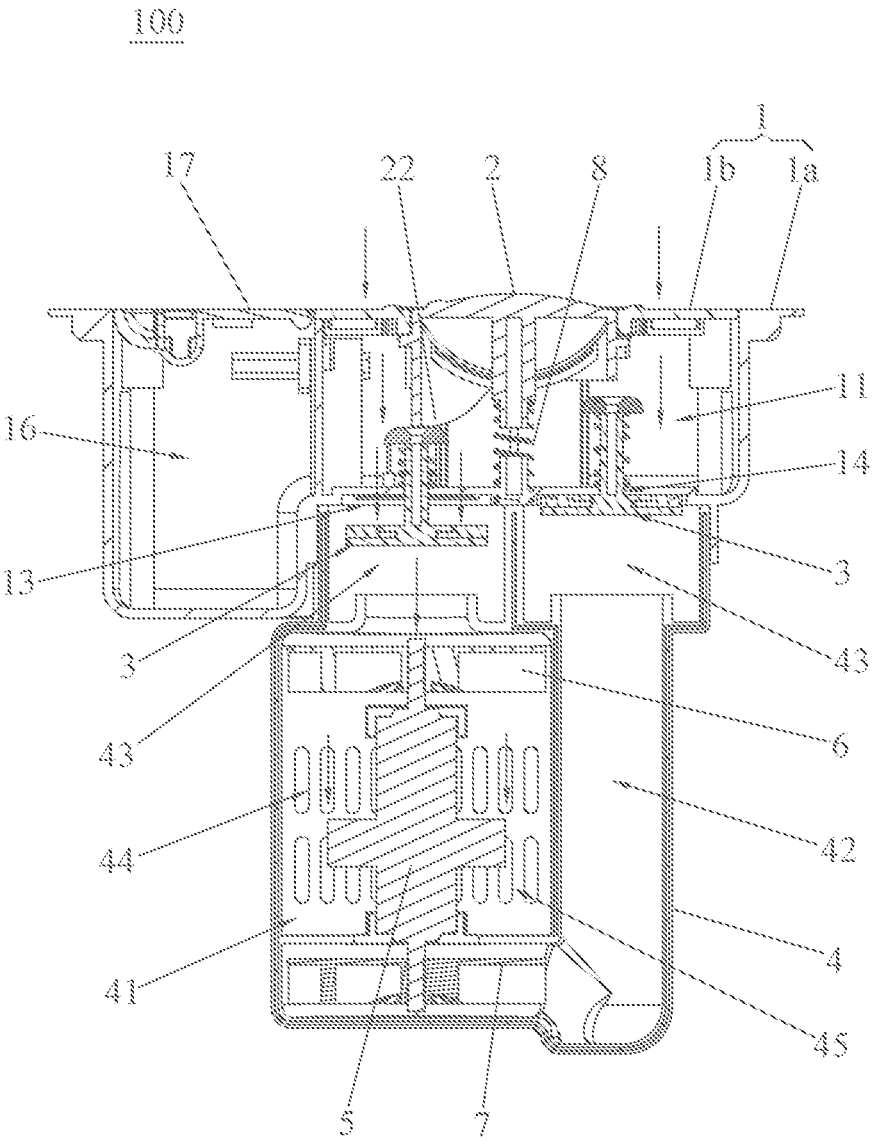
FIG. 5 shows a status of the dual-shaft built-in pump during inflation according to the first embodiment of the present invention.
Figure 6:
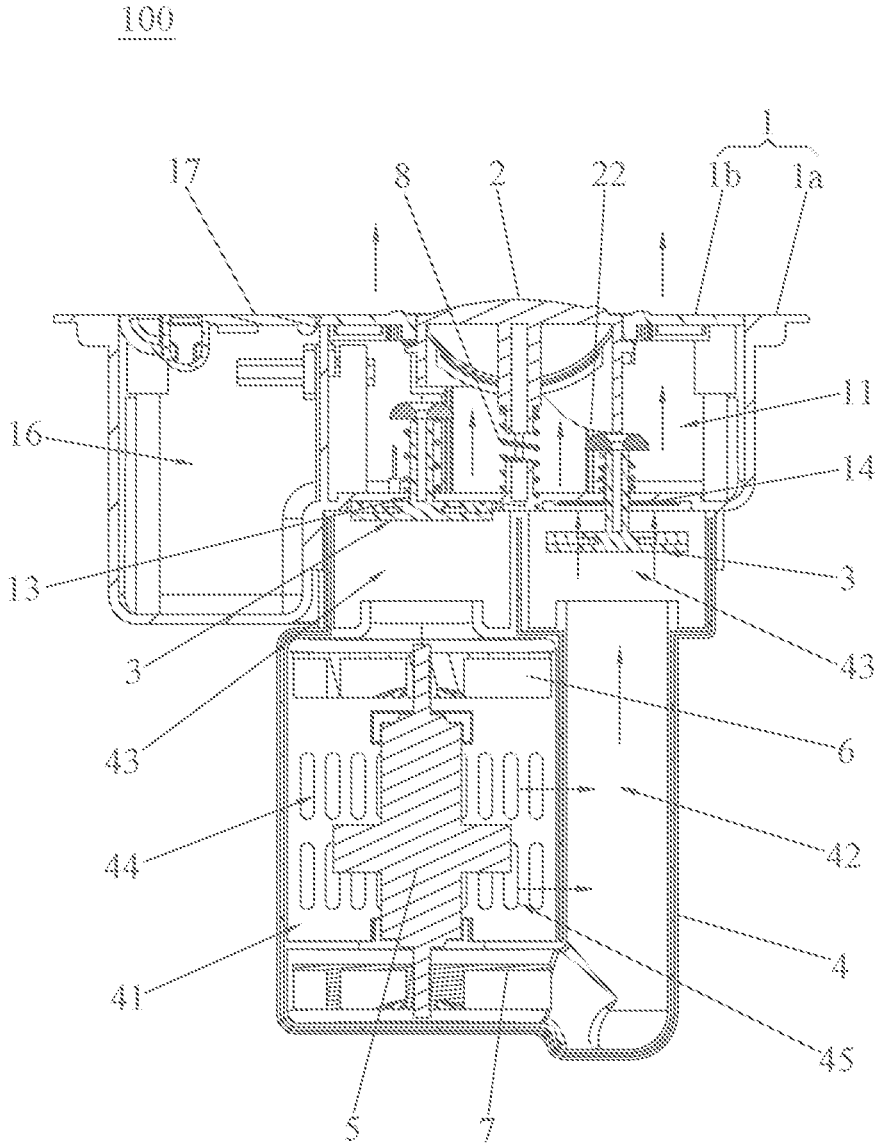
FIG. 6 shows a status of the dual-shaft built-in pump during deflation according to the first embodiment of the present invention.

Combining the above disclosure with FIGS. 5 and 6, the working principle of the dual-shaft built-in pump 100 of the present application is described in detail below.

When inflating, firstly the rotating member 2 is rotated, so that the rotating member 2 is turned to the inflation mark, at this time, the protruding portion 22 of the rotating member 2 is rotated to the top of the air inlet 13 to push the support 31 at the air inlet 13, and the elastic restoring member 32 is compressed by the support 31 to drive the sealing member 33 to be far away from the air inlet 13 and enter the movable chamber 43. At this time, the inlet 12, the inner cavity 11, the air inlet 13, the movable chamber 43, and the accommodating cavity 41 are communicated with the air inflation vent 44, and the valve body 3 located at the air outlet 14 still seals the air outlet 14 to maintain the air outlet duct 42 in a closed state. At this time, the dual-shaft motor 5 is started up, and the rotation of the output end of the dual-shaft motor 5 drives the rotations of both the first fan blade 6 and the second fan blade 7 at the same time. At this time, since only the first fan blade 6 pushes the airflow, therefore, the air enters from the inlet 12, passes through the inner cavity 11, the air inlet 13, the movable chamber 43, and the accommodating cavity 41, and then flows out from the air inflation vent 44, so that the air bag is inflated.

When deflating, firstly the rotating member 2 is rotated, so that the rotating member 2 is turned to the deflation mark, at this time, the protruding portion 22 of the rotating member 2 is rotated to the top of the air outlet 14 to push the support 31 at the air outlet 14, and the elastic restoring member 32 is compressed by the support 31 to drive the sealing member 33 to be far away from the air outlet 14 and enter the movable chamber 43. At this time, the inlet 12, the inner cavity 11, the air outlet 14, the movable chamber 43, the air outlet duct 42, and the accommodating cavity 41 are communicated with the air deflation vent 45, and the valve body 3 located at the air inlet 13 still seals the air inlet 13. At this time, the dual-shaft motor 5 is started up, and the rotation of the output end of the dual-shaft motor 5 drives the rotations of both the first fan blade 6 and the second fan blade 7 at the same time. At this time, since only the second fan blade 7 pushes the airflow, therefore, the air flows from the air deflation vent 44, and then passes through the accommodating cavity 41, the air outlet duct 42, the movable chamber 43, the air outlet 14, and the inner cavity 11, so that the air bag is deflated.

In comparison with the prior art, the air inlet 13 and the air outlet 14 are arranged in the inner cavity 11 of the main body 1 according to the present invention, so that the air inlet 13 is communicated with the air inflation vent 44 of the accommodating cavity 41, and the air outlet 14 is communicated with the air deflation vent 45 of the accommodating cavity 41, the first fan blade 6 is arranged between the air inflation vent 44 and the air inlet 13, the second fan blade 7 is arranged between the air deflation vent 45 and the air outlet duct 42, and two valve bodies 3 are arranged on the air inlet 13 and the air outlet 14, respectively. Therefore, either of the two valve bodies 3 can be driven by means of the rotating member 2, thereby opening the air inlet 13 and the air outlet 14. After the air inlet 13 is opened, the air can flow in through the air inflation vent; after the air outlet 14 is opened, the air can flow out from the air deflation vent. In such a way, there is no need to switch the air ducts inside the pump, the structure of the air duct is simplified, and the processing is convenient. In addition, the main body 1 and the motor cover 4 are configured, the rotating member 2 and the two valve bodies 3 are arranged on the main body 1, and the dual-shaft motor 5, the first fan blade 6 and the second fan blade 7 are arranged on the motor cover 4, therefore, it's only required to assemble the main body 1 with the motor cover during the assembly, which brings a simple assembly and reduced processing costs.

Figure 7:
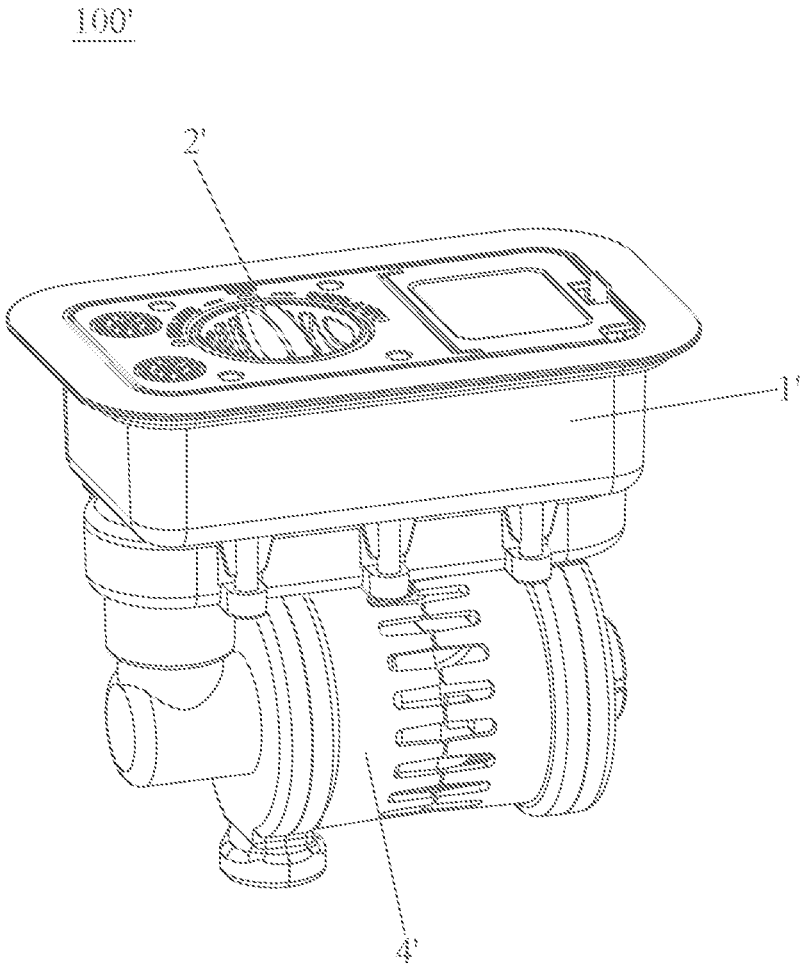
FIG. 7 is a perspective view of a dual-shaft built-in pump according to a second embodiment of the present invention.
Figure 8:
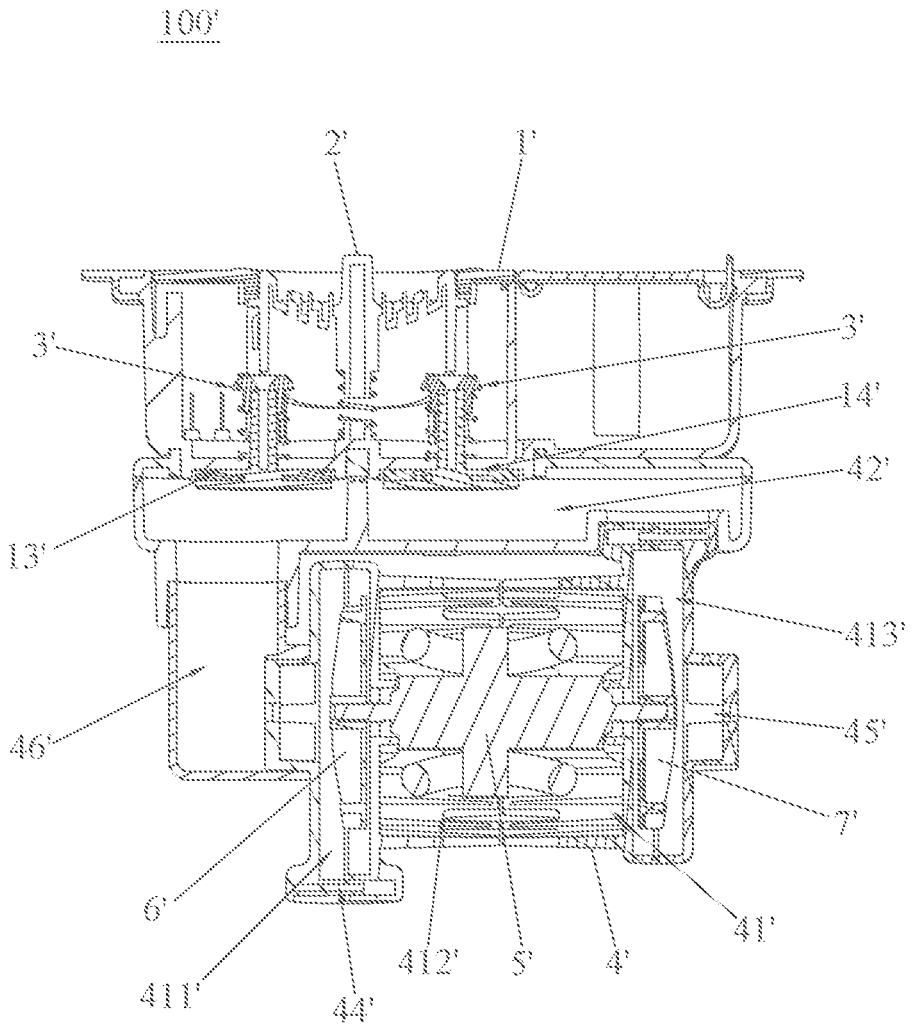
FIG. 8 is a cross-section view of the dual-shaft built-in pump according to the second embodiment of the present invention.

Referring to FIG. 7 and FIG. 8, a dual-shaft built-in pump 100' according to the second embodiment of the present invention is shown. The structure of the dual-shaft built-in pump 100' in this embodiment is substantially the same as that of the dual-shaft built-in pump 100 in the first embodiment. Specifically, the structures of the main body 1', rotating member 2' and two valve bodies 3 are the same, while the difference is that, the output shaft of the dual-shaft motor 5' of the dual-shaft built-in pump 100' of the second embodiment is perpendicular to the rotation center axis of the rotating member 2'; that is, the output shaft of the dual-shaft motor 5' of this embodiment is arranged laterally. More specifically, the accommodating cavity 41' is provided with a first cavity 411', a second cavity 412' and a third cavity 413, and the first fan 6' is located in the first cavity 411', the air inflation vent 44' is disposed in the first cavity 411' and communicated with the first cavity 411'; the second fan 7' is located in the third cavity 413', and the air deflation vent 45' is disposed in the third cavity 413' and communicated with the third cavity 413'. Both of the first fan blade 6' and the second fan blade 7' are centrifugal fan blades with the same structure, which are installed in the opposite direction to each other. The dual-shaft motor 5' is disposed in the third cavity 413'. Specifically, one side of the motor cover 4' is provided with an air inlet duct 46', and the other side is provided with an air outlet duct 42'. One end of the air inlet duct 46' is communicated to the air inlet 13', and the other end is communicated to the center of one side of the first cavity 411'. The air inflation vent 44' is located at a side wall of the first cavity 413' in the diameter direction. One end of the air outlet duct 42' is communicated to the air outlet 14', and the other end is communicated to a side wall of the third cavity 413' in the diameter direction and communicated with the third cavity 413'. The air deflation vent 45' is located at the center of one side of the third cavity 413'. The working principle and beneficial effects of the dual-shaft built-in pump 100' in the second embodiment are similar to those of the dual-shaft built-in pump 100 in the first embodiment, which is not repeated here.

Figure 9:
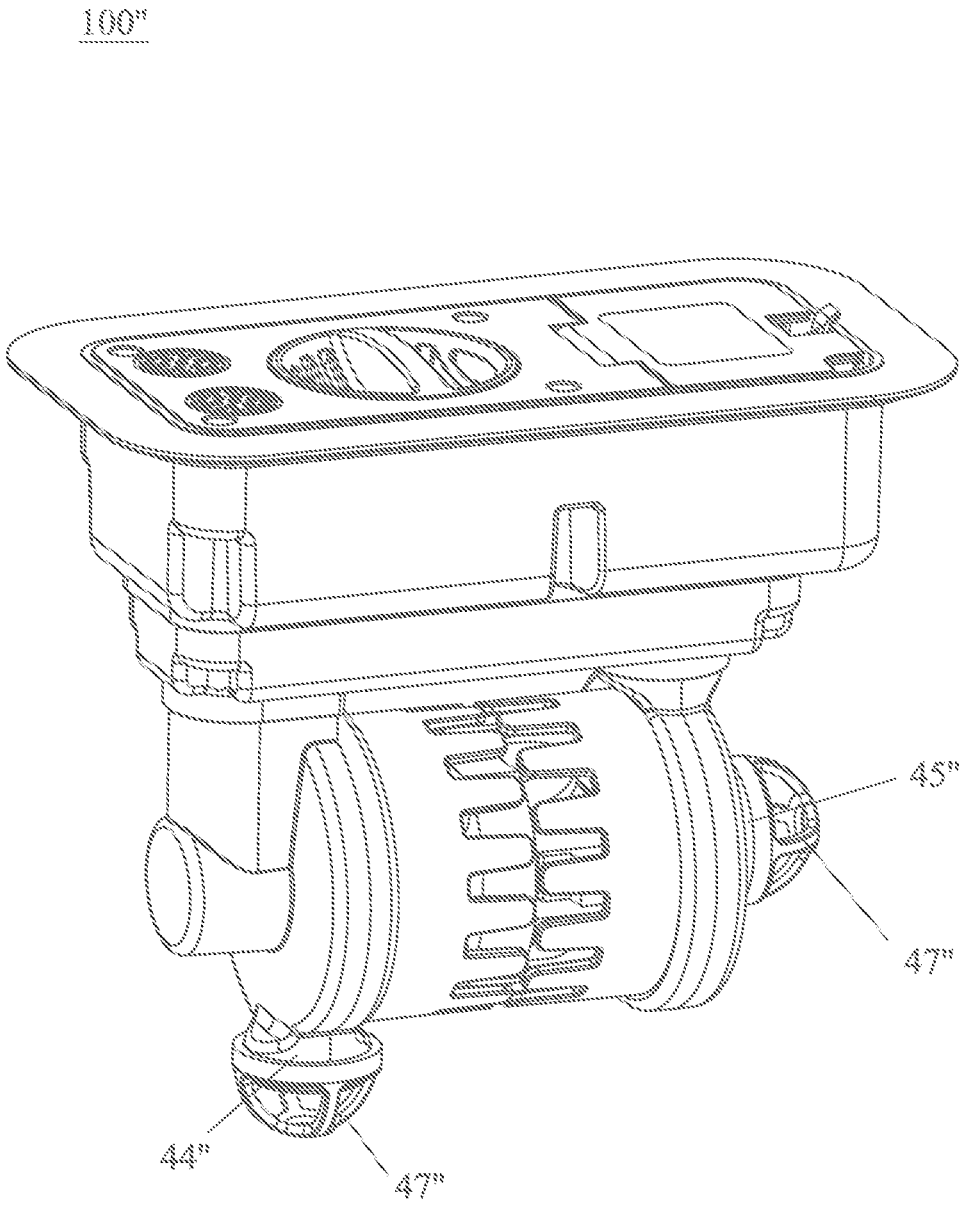
FIG. 9 is a perspective view of a dual-shaft built-in pump according to a third embodiment of the present invention.

Referring to FIG. 9, a dual-shaft built-in pump 100" according to the third embodiment of the present invention is shown. The structure of the dual-shaft built-in pump 100" in this embodiment is substantially the same as that of the dual-shaft built-in pump 100 in the second embodiment, and the difference is that, a protective casing 47" that is hollow is provided on the air inflation vent 44" and the air deflation vent 45", respectively. Preferably, the protective cover 47" is made of a flexible material, such as plastic or rubber, which protrudes toward the air bag of the inflatable product, so as to protect the air bag from damage during inflation or deflation. More preferably, the protective cover 47" is in the shape of a hemispheroid.

The above is only the preferred embodiment of the present application, and the scope of the application is not limited thereto, and thus equivalent changes made by the scope of the present application are still within the scope of the present application.

What is claimed is:

1. A dual-shaft built-in pump, comprising:

a main body, provided with an inner cavity and an inlet communicated with the inner cavity, and the inner cavity having an air inlet and an air outlet;

a motor cover, provided with an accommodating cavity having an air inflation vent that is communicated with the air inlet and an air deflation vent that is communicated with the air outlet;

two valve bodies, one of the valve bodies being configured at the air inlet, and another of the valve bodies being configured at the air outlet;

a first fan blade, located between the air inflation vent and the air inlet;

a second fan blade, located between the air deflation vent and the air outlet;

a dual-shaft motor, configured in the accommodating cavity and having an output shaft which has an end connected with the first fan blade and another end connected with the second fan blade; and a rotating member, rotatably provided on the main body and configured to drive either of the two valve bodies thereby opening the air inlet or the air outlet;

wherein the rotating member is single, the rotating member is provided with a guide rail and a protruding portion protruded along the guide rail, wherein when the rotating member is rotated, the protruding portion is rotated to drive one of the valve bodies in an open state, and another of the valve bodies is in a closed state.

2. The dual-shaft built-in pump according to claim 1, wherein the output shaft of the dual-shaft motor is parallel to an axis of the rotating member.

3. The dual-shaft built-in pump according to claim 2, wherein the air inflation vent and the air deflation vent are located between the first fan blade and the second fan blade.

4. The dual-shaft built-in pump according to claim 2, wherein the motor cover is provided with an air outlet duct, one end of the air outlet duct is communicated with the air outlet of the inner cavity, and another end of the air outlet duct is communicated with the air deflation vent of the accommodating cavity.

5. The dual-shaft built-in pump according to claim 1, wherein the output shaft of the dual-shaft motor is perpendicular to a rotation center axis of the rotating member.

6. The dual-shaft built-in pump according to claim 5, wherein the accommodating cavity is provided with a first cavity, a second cavity and a third cavity, and the first fan blade is located in the first cavity, the air inflation vent is communicated with the first cavity; the second fan blade is located in the third cavity, and the air deflation vent is communicated with the third cavity; and the dual-shaft motor is located in the first cavity, the second cavity and the third cavity.

7. The dual-shaft built-in pump according to claim 5, wherein one side of the motor cover is provided with an air inlet duct, and another side of the motor cover is provided with an air outlet duct; one end of the air inlet duct is communicated with the air inlet, and another end of the air inlet is communicated with the air inflation vent of the accommodating cavity; one end of the air outlet duct is communicated with the air inflation vent, and another end of the air outlet duct is communicated with the air deflation vent of the accommodating cavity.

8. The dual-shaft built-in pump according to claim 1, wherein each valve body comprises a support, an elastic restoring member and a sealing member, the support is movably configured in the main body, one end of the elastic restoring member is pressed against an inner wall of the support, and another end of the elastic restoring member is pressed against the support, the sealing member is disposed on the support and configured to seal the inner cavity under an elastic force of the elastic restoring member.

9. The dual-shaft built-in pump according to claim 1, wherein the motor cover is provided with two movable chambers isolated from one another, one of the movable chambers is located between the air inlet and the accommodating cavity and communicated with the accommodating cavity to receive the valve body disposed at the air inlet, another of the movable chambers is located between the air outlet and the accommodating cavity and communicated with the accommodating cavity to receive the valve body disposed at the air outlet.

10. The dual-shaft built-in pump according to claim 1, further comprising an elastic member configured between the main body and the rotating member, so that the rotating member is attached to the main body.

11. The dual-shaft built-in pump according to claim 10, wherein the rotating member is provided with an engaging portion, the main body is provided with a plurality of recesses, and the engaging portion is configured to engage with one of the recesses after the rotating member is rotated by an angle.

12. The dual-shaft built-in pump according to claim 1, wherein a surface of the main body is provided with a through hole communicating with the inner cavity, and the rotating member is configured at the through hole.

13. The dual-shaft built-in pump according to claim 1, wherein the main body is provided with a storage chamber for storing wires connected to the dual-shaft motor, and a cover is provided at an opening of the storage chamber.

14. The dual-shaft built-in pump according to claim 1, wherein the main body comprises a main portion and a top cover disposed on a surface of the main body, and an outer surface of the main body is provided with a rubber layer.

15. The dual-shaft built-in pump according to claim 1, wherein the air inflation vent and the air deflation vent are provided with a protective cover, respectively, which is hollow.

16. The dual-shaft built-in pump according to claim 15, wherein the protective cover is made of a flexible material.

17. A dual-shaft built-in pump, comprising:

a main body, provided with an inner cavity and an inlet communicated with the inner cavity, and the inner cavity having an air inlet and art air outlet;

a motor cover, provided with all accommodating cavity having an air inflation vent that is communicated with the air inlet and an air deflation vent that is communicated with the air outlet;

two valve bodies, one of the valve bodies being configured at the air inlet, and another of the valve bodes being configured at the air outlet;

a first fan blade, located between the air inflation vent and the air inlet;

a second fan blade, located between the air deflation vent and the air outlet; a dual-shaft motor, configured in the accommodating cavity and having an output shaft which has an end connected with the first fan blade and another end connected with the second fan blade; and a rotating, member rotatably provided on the main body and configured to drive either of the two valve bodies thereby opening, the air inlet or the air outlet;

wherein the output shaft of the dual-shaft motor is perpendicular to a rotation center axis of the rotating member;

one side of the motor cover is provided with an air inlet duct, and another side of the motor cover is provided with an air outlet duct; one end of the air inlet duct is communicated with the air inlet, and another end of the air inlet is communicated with the air inflation vent of the accommodating cavity; one end of the air outlet duct is communicated with the air inflation vent, and another end of the air outlet duct is communicated with the air deflation vent of the accommodating cavity.

18. The dual-shaft built-in pump according to claim 17, wherein the accommodating cavity is provided with a first cavity, a second cavity and a third cavity, and the first fan blade is located in the first cavity, the air inflation vent is communicated with the first cavity; the second fan blade is located in the third cavity, and the air deflation vent is communicated with the third cavity; and the dual-shaft motor is located in the first cavity, the second cavity and the third cavity.

* * * * *